US011441218B2

(12) United States Patent
Satoh et al.

(10) Patent No.: US 11,441,218 B2
(45) **Date of Patent: *Sep. 13, 2022**

(54) MNAL ALLOY AND PRODUCTION METHOD THEREOF

(71) Applicant: TDK CORPORATION, Tokyo (JP)

(72) Inventors: Suguru Satoh, Tokyo (JP); Shuichiro Irie, Tokyo (JP); Yasunao Miura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 424 days.

This patent is subject to a terminal disclaimer.

(21) Appl. No.: 16/475,439

(22) PCT Filed: Dec. 27, 2017

(86) PCT No.: PCT/JP2017/046985

§ 371 (c)(1),
(2) Date: Jul. 2, 2019

(87) PCT Pub. No.: WO2018/128152

PCT Pub. Date: Jul. 12, 2018

(65) Prior Publication Data

US 2019/0338406 A1 Nov. 7, 2019

(30) Foreign Application Priority Data

Jan. 5, 2017 (JP) ..... JP2017-000364

(51) Int. Cl.

| | |
|---|---|
| ***C22F 1/16*** | (2006.01) |
| ***C22C 21/00*** | (2006.01) |
| ***C22C 22/00*** | (2006.01) |
| ***C22F 1/04*** | (2006.01) |
| ***H01F 1/147*** | (2006.01) |

(Continued)

(52) U.S. Cl.
CPC ..... *C22F 1/16* (2013.01); *B22F 1/142* (2022.01); *C22C 21/00* (2013.01); *C22C 22/00* (2013.01);

(Continued)

(58) Field of Classification Search
CPC ..... C22C 21/00; C22C 22/00
See application file for complete search history.

(56) References Cited

U.S. PATENT DOCUMENTS

| | | | |
|---|---|---|---|
| 2009/0158749 | A1 | 6/2009 | Sandeman et al. |
| 2015/0115748 | A1 | 4/2015 | Shimanouchi et al. |

(Continued)

FOREIGN PATENT DOCUMENTS

| | | | |
|---|---|---|---|
| GB | 927289 | A | 5/1963 |
| JP | 2014228166 | A | 12/2014 |

OTHER PUBLICATIONS

M. Lyange, V. Khovaylo, R. Singh, S.K. Srivastava, R. Chatterjee, L.K. Varga, Phase transitions and magnetic properties of Ni(Co)—Mn—Al melt-spun ribbons, Feb. 15, 2014, Journal of Alloys and Compounds, vol. 586, Supplement 1, Pages S218-S221 (Year: 2014).*

(Continued)

*Primary Examiner* — Nicholas A Wang
*Assistant Examiner* — Maxwell Xavier Duffy
(74) *Attorney, Agent, or Firm* — Young Law Firm, P.C.

(57) ABSTRACT

An object of the present invention is to provide a Mn-based alloy exhibiting metamagnetism over a wide temperature range. A Mn-based alloy according to the present invention is a MnAl alloy having metamagnetism. The metamagnetism refers to a property in which magnetism undergoes transition from paramagnetism or antiferromagnetism to ferromagnetism by a magnetic field. In the MnAl alloy, an antiferromagnetic state is adequately stable, so that by imparting AFM-FM transition type metamagnetism (the type of metamagnetism undergoing transition from antiferromagnetism to ferromagnetism), it is possible to obtain metamagnetism over a wide temperature range, particularly, over a temperature range of −100° C. to 200° C.

10 Claims, 7 Drawing Sheets

(51) Int. Cl.
*B22F 1/142* (2022.01)
*B22F 9/04* (2006.01)

(52) U.S. Cl.
CPC ..... *C22F 1/04* (2013.01); *H01F 1/147* (2013.01); *B22F 9/04* (2013.01); *B22F 2301/052* (2013.01); *C22C 2202/02* (2013.01)

(56) References Cited

U.S. PATENT DOCUMENTS

2016/0307677 A1 10/2016 Baker et al.
2020/0002790 A1* 1/2020 Satoh ..... C22C 1/02

OTHER PUBLICATIONS

J. H. Park, Y. K. Hong, S. Bae, Saturation magnetization and crystalline anisotropy calculations for MnAl permanent magnet, Apr. 21, 2010, Journal of Applied Physics, 107, pp. 09A731-1 to 09A731-3 (Year: 2010).*

R. W. McCallum, L. H. Lewis, R. Skomski, M. J. Kramer, I. E. Anderson, Practical Aspects of Modern and Future Permanent Magnets, Apr. 10, 2014, Annual Review of Materials Research, vol. 44, p. 451-477 (Year: 2014).*

Neutron diffraction study of hard magnetic alloy MnAlC Yingchang Yang, Wenwang Ho, Chin Lin, Jilian Yang, Huiming Zhou et al. J. Appl. Phys. 55, 2053 (1984); doi: 10.1063/1.333563.

The Electrodeposition of Al—Mn ferromagnetic phase from molten salt electrolyte, G.R. Stafford et al., Journal of Alloys and Compounds, 200 (1993) 107-113 JALCOM 771.

J.H. Park et et., Saturation magnetization and crystalline anisotropy calculations for MnAl permanent magnet, Journal of Applied Physics 107, 09A731 (2010).

* cited by examiner

| | Manufacturing Process | Electrodeposition Temperature (℃) | Heat Treatment Temperature (℃) | Mn ratio in MnAl Arroy (Atom%) | Metamagnetism | Saturation Magnetization (emu/g) | Residual Magnetization | Antiferromagnetic Stricture | Mn ratio in τ-MnAl phase (Atom%) | Order Parameter S |
|---|---|---|---|---|---|---|---|---|---|---|
| Comparative Example 1 | Electrodeposition Method | 350 | No | 50 | No | 79.4 | Yes | Yes | 50 | 0.76 |
| Comparative Example 2 | Electrodeposition Method | 300 | No | 47.5 | No | 69.2 | Yes | Yes | 47.5 | 0.74 |
| Comparative Example 3 | Electrodeposition Method | 250 | No | 45 | No | 51.2 | Yes | Yes | 45 | 0.73 |
| Comparative Example 4 | Electrodeposition Method | 350 | 350 | 50 | No | 79.4 | Yes | Yes | 50 | 0.76 |
| Example 1 | Electrodeposition Method | 350 | 400 | 50 | Yes | 95.0 | Yes | Yes | 51 | 0.85 |
| Example 2 | Electrodeposition Method | 350 | 450 | 50 | Yes | 116.1 | Yes | Yes | 52 | 0.89 |
| Example 3 | Electrodeposition Method | 350 | 500 | 50 | Yes | 115.7 | No | Yes | 53 | 0.90 |
| Example 4 | Electrodeposition Method | 350 | 550 | 50 | Yes | 103.1 | No | Yes | 54.5 | 0.85 |
| Example 5 | Electrodeposition Method | 350 | 575 | 50 | Yes | 65.8 | No | Yes | 54.8 | 0.83 |
| Example 6 | Electrodeposition Method | 300 | 550 | 47.5 | Yes | 47.9 | No | Yes | 49 | 0.90 |
| Example 7 | Electrodeposition Method | 250 | 550 | 45 | Yes | 25.5 | No | Yes | 48 | 0.89 |
| Comparative Example 5 | Electrodeposition Method | 350 | 600 | 50 | No | 9.2 | No | Yes | 55 | 0.83 |
| Comparative Example 6 | Electrodeposition Method | 350 | 650 | 50 | No | 1.2 | -- | Yes | -- | -- |
| Comparative Example 7 | Electrodeposition Method | 350 | 700 | 50 | No | 0.5 | -- | Yes | -- | -- |
| Comparative Example 8 | Melting Method | – | – | 46 | No | 1.2 | – | No | – | – |
| Comparative Example 9 | Melting Method | – | – | 48 | No | 4.2 | – | No | – | – |
| Comparative Example 10 | Melting Method | – | – | 50 | No | 7.2 | – | No | – | – |
| Comparative Example 11 | Melting Method | -- | -- | 52 | No | 56.0 | Yes | No | 55 | 0.83 |
| Comparative Example 12 | Melting Method | -- | -- | 54 | No | 82.0 | Yes | No | 55 | 0.83 |
| Comparative Example 13 | Melting Method | -- | -- | 55 | No | 108.0 | Yes | No | 55 | 0.83 |
| Comparative Example 14 | Melting Method | – | – | 56 | No | 99.2 | Yes | No | 56 | 0.80 |

FIG. 7

MNAL ALLOY AND PRODUCTION METHOD THEREOF

TECHNICAL FIELD

The present invention relates to a MnAl alloy and its manufacturing method and, more particularly, to a MnAl alloy having metamagnetism and its manufacturing method.

BACKGROUND ART

A MnAl alloy is hitherto known as a magnetic material. For example, the MnAl alloy disclosed in Patent Document 1 has a tetragonal structure and has a Mn/Al ratio of 5:4 to thereby exhibit magnetism. More specifically, the atom ratio of Mn/Al is set to about 55.5:44.5, and an ε-MnAl phase produced at 1100° C. is subjected to adequate heat treatment, whereby a ferromagnetic phase called a τ-MnAl phase having a tetragonal structure and having a c/a of about 1.3, and in which Mn or Al occupies atomic coordinates (0, 0, 0) and (½, ½, ½) is obtained.

The τ-MnAl phase is an L10-type ordered alloy in which Mn and Al preferentially occupies atomic coordinates (0, 0, 0) or (½, ½, ½). There is no difference in crystal structure whether Al or Mn preferentially occupies the atomic coordinates (0, 0, 0) or (½, ½, ½), so hereinafter, the atomic coordinates that Mn preferentially occupies in the τ-MnAl phase are referred to as a Mn site, and the atomic coordinates that Al preferentially occupies in the τ-MnAl phase are referred to as an Al site. In a perfectly-ordered τ-MnAl phase, only Mn occupies the Mn site, only Al occupies the Al site, and the atomic ratio of Mn/Al is 50:50; however, it is known that most of the excess of Mn over the amount of Al occupies the Al site (Non-Patent Document 1) in the τ-MnAl phase produced according to the method disclosed in Patent Document 1.

Further, in Non-Patent Document 2, an τ-MnAl phase in which a Mn ratio of less than 50% in the atomic ratio of Mn/Al is produced at 300° C. or less by an electrodeposition method, and the produced τ-MnAl phase exhibits ferromagnetism.

Further, as disclosed in Patent Document 2, it is known that some of the magnetic materials having Mn as a main constituent element exhibit metamagnetism. The metamagnetism refers to a property in which magnetism undergoes transition from paramagnetism or antiferromagnetism to ferromagnetism by a magnetic field. A metamagnetic material exhibiting the metamagnetism is expected to be applied to a magnetic refrigerator, an actuator, and a current limiter.

CITATION LIST

Patent Document

[Patent Document 1] JP S36-11110 B
[Patent Document 2] JP 2014-228166 A

Non-Patent Document

[Non-Patent Document 1] Y. Yang et al., J. Appl. Phys. 55 (1984) 2053-2054
[Non-Patent Document 2] G. R. Stafford et al., J. Alloy Compd. 200 (1993) 107-113

SUMMARY OF INVENTION

Technical Problem to be Solved by Invention

However, the metamagnetic materials described in Patent Document 2 all utilize first-order phase transition from paramagnetism to ferromagnetism by a magnetic field, so that they exhibit the metamagnetism only in the vicinity of the Curie temperature. Thus, practically, it is difficult to apply the metamagnetic materials to a current limiter and the like.

The present invention has been made in view of the above situation, and the object thereof is to provide a Mn-based alloy exhibiting the metamagnetism over a wide temperature range and a manufacturing method for such a Mn-based alloy.

Means for Solving the Problem

To solve the above problem and attain the object, the present inventors focused on a metamagnetic material (hereinafter, referred to as "AFM-FM transition type metamagnetic material") of a type undergoing transition from antiferromagnetism to ferromagnetism by a magnetic field. This is for the following reason: the AFM-FM transition type metamagnetic material exhibits metamagnetism at a temperature equal to or less than the Neel temperature where the antiferromagnetic order disappears, so that, unlike a metamagnetic material (hereinafter, referred to as "PM-FM transition type metamagnetic material") of a type undergoing transition from paramagnetism to ferromagnetism, it is not necessary to maintain a narrow temperature zone around the Curie temperature.

High crystal magnetic anisotropy and antiferromagnetism are required for realizing AFM-FM transition type metamagnetism. Thus, the present inventors focused on a Mn-based magnetic material using Mn exhibiting antiferromagnetism alone as the AFM-FM transition type metamagnetic material and examined various alloys/compounds. As a result, it was found that metamagnetism was exhibited over a wide temperature range by imparting an antiferromagnetic element to MnAl which is a comparatively rare Mn-based alloy that exhibits ferromagnetism. The present invention has been made based on the above finding, and a MnAl alloy according to the present invention is characterized by having metamagnetism.

The MnAl alloy according to the present invention preferably satisfies $45 \leq b \leq 50$ when the composition thereof is expressed by $Mn_bAl_{100-b}$. By setting the ratio between Mn and Al in this range, it is possible to impart metamagnetism to the MnAl alloy.

The MnAl alloy according to the present invention preferably contains a τ-MnAl phase, and the magnetic structure of the τ-MnAl phase preferably has an antiferromagnetic structure. By using the MnAl-based alloy whose antiferromagnetism is stable in a non-magnetic field state before phase transition, an AFM-FM transition type metamagnetic material is realized. When the stability of the antiferromagnetic state is too high, it is impossible to make phase transition to ferromagnetism by a magnetic field. On the other hand, when the stability of the antiferromagnetism is too low, phase transition to ferromagnetism may occur even with non-magnetic field or very weak magnetic field. In the MnAl alloy, an antiferromagnetic state is adequately stable, so that by imparting AFM-FM transition type metamagnetism, it is possible to obtain metamagnetism over a wide temperature range.

A mechanism of antiferromagnetism in the τ-MnAl phase by adjusting the amount of Mn on the Al site was examined by a first principle calculation, and it was found that the antiferromagnetism is caused by super exchange interaction between Mn atoms on the Mn site through p-orbital valence electrons in Al atoms in the Al site. The super exchange interaction is a kind of mechanism of exchange interaction in which 3d-orbital valence electrons of transition metal atoms work through orbital mixing with the p-orbital valence electrons in atoms having p-orbital valence electrons called ligand. When the angle among the transition metal atom, ligand, and transition metal atom experiencing coupling is close to 180°, antiferromagnetic coupling occurs. That is, in the τ-MnAl phase, the angle among Mn on the Mn site, Al on the Al site which is the ligand, and Mn in the directions (1, 1, 0) and (1, 1, 1) from the Mn site is close to 180°, and thus the antiferromagnetic coupling occurs. In addition, when Mn atoms are substituted on the Al site, the super exchange interaction does not occur between Mn atoms on the Mn site, and thus an antiferromagnetic structure is difficult to form. From the above findings, it was found that the stability of antiferromagnetism can be adjusted by adjusting the amount Mn on the Al site in the τ-MnAl phase.

Further, the MnAl alloy according to the present invention preferably includes a τ-MnAl phase, and $48 \leq a < 55$ is preferably satisfied when the composition of the τ-MnAl phase is expressed by $Mn_aAl_{100-a}$. When $a<48$, the amount of Mn on the Al site becomes small, the stability of the antiferromagnetic state becomes very high, with the result that a magnetic field required for magnetic phase transition becomes large, which is disadvantageous for application. When $a \geq 55$, Mn is contained more than Al, so that Mn is easily substituted on the Al site. The Mn substituted on the Al site is coupled antiferromagnetically to Mn on the Mn site, whereby Mn atoms on the Mn site are coupled ferromagnetically. As a result, ferrimagnetism occurs in the entire τ-MnAl phase, making it difficult to obtain metamagnetism. By setting the ratio of Mn in the τ-MnAl phase so as to satisfy $48 \leq a < 55$, preferably, $50 < a < 55$, and by adjusting the stability of the antiferromagnetic state in a non-magnetic field state, it is possible to realize the AFM-FM transition type metamagnetism and thus to obtain meta magnetism over a wide temperature range, particularly, over a temperature range of −100° C. to 200° C.

Further, order parameter S of the τ-MnAl phase in the MnAl alloy according to the present invention is preferably 0.85 or more. When the order parameter S is less than 0.85, Mn is easily substituted on the Al site. The Mn substituted on the Al site is coupled to Mn on the Mn site antiferromagnetically, whereby Mn atoms on the Mn site are coupled ferromagnetically. As a result, ferrimagnetism occurs in the entire τ-MnAl phase, making it difficult to obtain metamagnetism.

The order parameter S is a measure indicating regular arrangement in a Mn crystalline phase and an Al crystalline phase in the τ-MnAl phase, in which 1 is set as the upper limit. Order parameter S=1 indicates a state where only Mn occupies the Mn site and only Al occupies the Al site. In the case of order parameter $S<1$, when, for example, g % Mn and (10−g) % Al occupy the Mn site, and g % Al and (100−g) % Mn occupy the Al site, S is calculated by $(g-50)\times 2/100$.

The MnAl alloy according to the present invention is preferably in a powder form. Thus, it is possible to obtain a desired product shape by compression molding the powdery MnAl alloy.

A MnAl alloy manufacturing method according to the present invention includes a step of depositing a MnAl alloy by electrolyzing molten salt containing a Mn compound and an Al compound and a step of applying heat treatment to the MnAl alloy at a temperature of 400° C. or more and less than 600° C. By thus applying heat treatment to the MnAl alloy formed by a molten salt electrolysis method, it is possible to impart metamagnetism to the MnAl alloy. In the τ-MnAl phase produced by a method of applying heat treatment to the τ-MnAl phase, which is a conventional MnAl alloy manufacturing method, it is difficult to control the Mn ratio to less than 55 at % at which the τ-MnAl phase is stable, making it impossible to obtain metamagnetism. Further, the τ-MnAl phase contained in the MnAl alloy produced by the electrolysis method is generated at a low temperature of less than 300° C., so that the order parameter S of the τ-MnAl phase is less than 0.85 unless heat treatment is applied and, thus, metamagnetism cannot be obtained. As described above, by applying heat treatment to the τ-MnAl phase which is contained in the MnAl alloy formed by the molten salt electrolysis method and whose Mn ratio is less than 55 at % at a predetermined temperature and controlling the order parameter S of the τ-MnAl phase to 0.85 or more, it is possible to impart metamagnetism to the MnAl alloy.

Advantageous Effects of the Invention

As described above, according to the present invention, there can be provided a MnAl alloy exhibiting metamagnetism over a wide temperature range.

BRIEF DESCRIPTION OF DRAWINGS

FIG. 5 is a graph illustrating the second order differential value of the characteristics illustrated in

FIG. 3.

FIG. 7 is a table indicating manufacturing conditions and evaluation results of Examples 1 to 7 and Comparative Examples 1 to 14.

MODE FOR CARRYING OUT THE INVENTION

Figure 1:
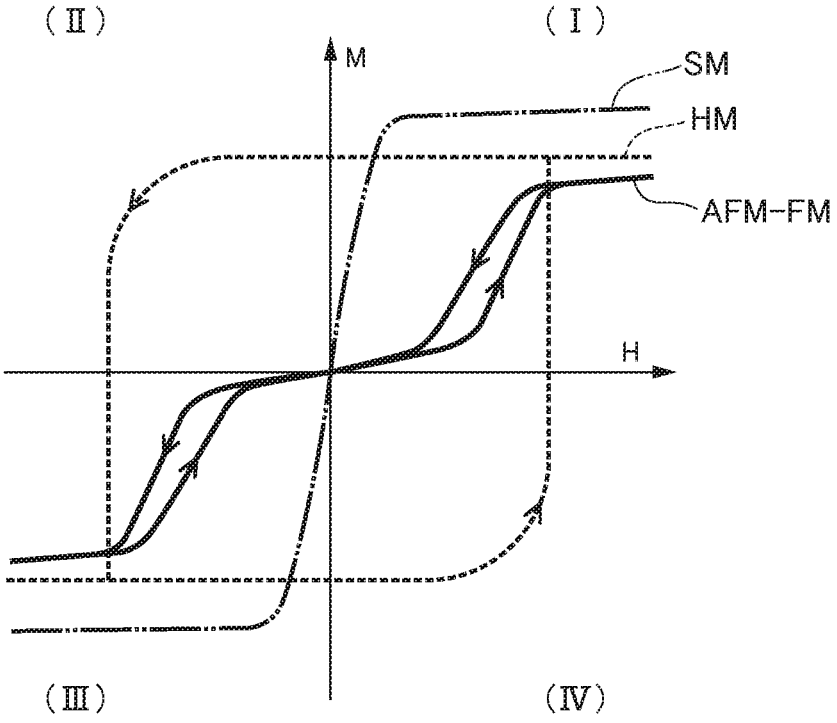
FIG. 1 is a graph illustrating the magnetic characteristics of the MnAl alloy exhibiting metamagnetism.

Hereinafter, preferred embodiments of the present invention will be described. The present invention is not limited to the embodiments and examples described below. Further, the constituent elements shown in the following embodiments and examples can be appropriately combined or selected for use.

The metamagnetism refers to a property in which magnetism undergoes first-order phase transition from paramagnetism (PM) or antiferromagnetism (AFM) to ferromagnetism (FM) by a magnetic field. The first-order phase transition by a magnetic field refers to the occurrence of discontinuity in a change in magnetization under a magnetic field. The metamagnetic material is classified into a PM-FM transition type metamagnetic material in which magnetism undergoes transition from paramagnetism to ferromagnetism by a magnetic field and an AFM-FM transition type metamagnetic material in which magnetism undergoes transition from antiferromagnetism to ferromagnetism by a magnetic field. In the PM-FM transition type metamagnetic material, the first-order phase transition occurs only in the vicinity of the Curie temperature; on the other hand, in the AFM-FM transition type metamagnetic material, the first-order phase transition occurs at a temperature equal to or less than the Neel temperature where the antiferromagnetism order disappears. The MnAl alloy according to the present embodiment is the AFM-FM transition type metamagnetic material, so that it exhibits metamagnetism over a wide temperature range.

Further, the MnAl alloy according to the present embodiment contains the τ-MnAl phase, and the magnetic structure of the τ-MnAl phase has an antiferromagnetic structure. The antiferromagnetic structure refers to a structure in which spin as the origin of magnetism of a magnetic material has a spatially periodic structure, and magnetization (spontaneous magnetization) as the entire magnetic material is absent, which differs from a paramagnetic structure in which the spin does not have a spatially periodic structure but has a disordered structure, and magnetization as the entire magnetic material is absent. By using the MnAl alloy whose antiferromagnetism becomes stable in a non-magnetic field state before the phase transition, the AFM-FM transition type metamagnetic material can be realized. When the stability of the antiferromagnetic state is too high, a magnetic field required for magnetic phase transition to ferromagnetism becomes too large, substantially disabling the occurrence of magnetic phase transition by a magnetic field. On the other hand, when the stability of the antiferromagnetic state is too low, magnetic phase transition to ferromagnetism may occur even in a non-magnetic field state or with a very weak magnetic field. By adjusting the stability of the antiferromagnetic state and imparting the AFM-FM transition type metamagnetism, the MnAl alloy can exhibit metamagnetism over a wide temperature range.

The MnAl alloy according to the present embodiment is preferably composed of only by the τ-MnAl phase having the antiferromagnetic structure but may partially contain a ferromagnetic structure, a paramagnetic structure, or a ferrimagnetic structure. Further, while the antiferromagnetic structure of the τ-MnAl phase in the MnAl alloy may have a colinear type antiferromagnetic structure having a constant spin axis or a noncolinear type antiferromagnetic structure having a non-constant spin axis as long as it exhibits the metamagnetism, the antiferromagnetic structure having a long-period magnetic structure is more applicable since a magnetic field required for transition from antiferromagnetism to ferromagnetism is small.

In order for the τ-MnAl phase in the MnAl alloy according to the present embodiment to have the antiferromagnetic structure, the Al site in the τ-MnAl phase is preferably occupied by Al. In this case, the atom occupying the Al site may be any atom that has p-orbital valence electrons. Specifically, B, Ga, In, Tl, C, Si, Ge, Sn, Pb, N, P, As, Sb, Bi, O, S, Se, Te, Po, F, Cl, Br, I, and At having the p-orbital valence electrons may be candidates therefor.

The MnAl alloy according to the present embodiment contains the τ-MnAl phase, and when the composition formula of the τ-MnAl phase is expressed by $Mn_aAl_{100-a}$, $48 \leq a < 55$ is preferably satisfied, and more preferably, $50 < a < 55$ is satisfied. When $a < 48$, the amount of Mn on the Al site becomes small, the stability of the antiferromagnetic state becomes very high, with the result that a magnetic field required for magnetic phase transition becomes large, which is disadvantageous for application. When $a \geq 55$, Mn is contained more than Al, so that Mn is easily substituted on the Al site. The Mn substituted on the Al site is coupled antiferromagnetically to Mn on the Mn site, whereby Mn atoms on the Mn site are coupled ferromagnetically. As a result, ferrimagnetism occurs in the entire τ-MnAl phase, making it difficult to obtain metamagnetism. By setting the ratio of Mn in the τ-MnAl phase so as to satisfy $48 \leq a < 55$, preferably, $50 < a < 55$, and by adjusting the stability of the antiferromagnetic state in a non-magnetic field state, it is possible to realize the AFM-FM transition type metamagnetism and thus to obtain meta magnetism over a wide temperature range.

When the composition formula of the τ-MnAl phase is expressed by $Mn_aAl_{100-a}$, the MnAl alloy according to the present embodiment is preferably composed only of crystal grains satisfying $50 < a < 55$ and, more preferably, $50 < a \leq 53$. By setting a to a value close to or equal to or less than 53, high maximum mass magnetization can be obtained. Further, since the vicinity of a=53 is the stability boundary between the antiferromagnetic structure and the ferromagnetic structure, a magnetic field required for transition from antiferromagnetism to ferromagnetism tends to be reduced, which is advantageous for application.

When the composition formula of the τ-MnAl phase is expressed by $Mn_aAl_{100-a}$, the MnAl alloy according to the present embodiment is preferably composed only of crystal grains satisfying $50 < a < 55$; however, the MnAl alloy may contain different phases such as a γ2-MnAl phase, a β-MnAl phase, and an amorphous phase as long as it has metamagnetism. Further, as long as metamagnetism is exhibited, the MnAl alloy may be a multicomponent MnAl alloy in which a part of the Mn site or a part of the Al site is substituted with Fe, Co, Cr, or Ni.

Further, order parameter S of the τ-MnAl phase in the MnAl alloy according to the present invention is preferably 0.85 or more. When the order parameter is less than 0.85, Mn is easily substituted on the Al site. The Mn substituted on the Al site is coupled antiferromagnetically to Mn on the Mn site, whereby Mn atoms on the Mn site are coupled ferromagnetically. As a result, ferrimagnetism occurs in the entire τ-MnAl phase, and thus metamagnetism cannot be obtained.

FIG. 1 is a graph illustrating the magnetic characteristics of the MnAl alloy according to the present embodiment. In FIG. 1, the horizontal axis (X-axis) as a first axis indicates a magnetic field H, and the vertical axis (Y-axis) as a second axis indicates magnetization M. Further, in FIG. 1, "AFM-FM" indicates the magnetic characteristics of the MnAl alloy according to the present embodiment, "SM" indicates the magnetic characteristics of a typical soft magnetic material, and "HM" indicates the magnetic characteristics of a typical hard magnetic material.

As indicated by "SM" in FIG. 1, the typical soft magnetic material exhibits high permeability and is thus easily magnetized in the low magnetic field region, while when magnetic field strength exceeds a predetermined value, it is magnetically saturated and is hardly magnetized any further. In other words, in the magnetic field region where magnetic saturation does not occur, the differential value of the magnetization M with respect to the magnetic field H becomes large, while in the magnetic field region where magnetic saturation can occur, the differential value of the magnetization M with respect to the magnetic field H becomes small. Further, the typical soft magnetic material has no hysteresis or has very small hysteresis, so that the characteristic curve denoted by "SM" passes the origin of the graph or in the vicinity thereof. Therefore, the characteristic curve denoted by "SM" appears in the first quadrant (I) and third quadrant (III) of the graph and does not substantially appear in the second quadrant (II) and fourth quadrant (IV).

As indicated by "HM" in FIG. 1, the typical hard magnetic material has large hysteresis, and thus a magnetized state is maintained even with zero magnetic field. Therefore, the characteristic curve denoted by "HM" appears in all the first (I) to fourth (IV) quadrants.

On the other hand, as indicated by "AFM-FM" in the first and third quadrants (I) and (III) of the graph, the MnAl alloy according to the present embodiment exhibits the following characteristics: in the low magnetic region, it exhibits low permeability and is thus hardly magnetized; in the middle magnetic field region, it exhibits increased permeability and is easily magnetized; and in the high magnetic field region, it is magnetically saturated and is hardly magnetized any further. While slight hysteresis exists in the first and third quadrants (I) and (III) depending on electrodeposition conditions and heat treatment conditions described later, residual magnetization is zero or very small, so that the characteristic curve denoted by "AFM-FM" substantially passes the origin of the graph. Even when the characteristic curve denoted by "AFM-FM" does not pass exactly the origin of the graph, it passes in the vicinity of the origin with respect to the horizontal or vertical axis. This means that the same magnetic characteristics can be obtained irrespective of whether the MnAl alloy according to the present embodiment is in the initial state or in a state after it has repeatedly been applied with a magnetic field.

Figure 2:
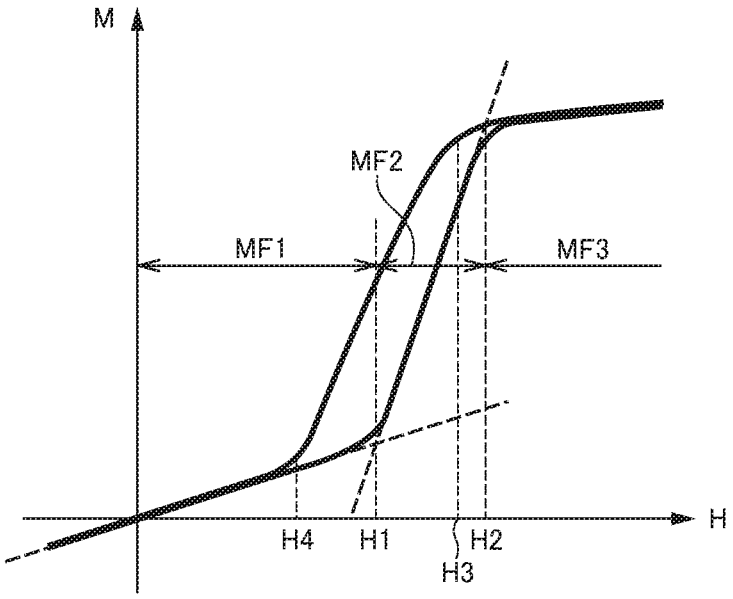
FIG. 2 is a graph illustrating the magnetic characteristics of the MnAl alloy exhibiting metamagnetism, where only the first quadrant (I) is illustrated.

FIG. 2 is a graph illustrating the magnetic characteristics of the MnAl alloy according to the present embodiment. In this graph, only the first quadrant (I) is illustrated.

The magnetic characteristics of the MnAl alloy according to the present embodiment will be described more specifically by way of FIG. 2. When the magnetic field is increased from a state where the magnetic field H is absent, the permeability is low in the region (first magnetic field region MF1) up to a first magnetic field strength H1, and thus increase in the magnetization M is small. The inclination of the graph, i.e., the differential value of the magnetization M with respect to the magnetic field H changes with the permeability. The permeability in the first magnetic field region MF1 is almost the same with the permeability of a non-magnetic material, so that the MnAl alloy according to the present embodiment behaves substantially as a non-magnetic material in the first magnetic field region MF1.

On the other hand, the permeability rapidly increases in the region (second magnetic field region MF2) from the first magnetic field strength H1 to a second magnetic field strength H2, and thus the value of the magnetization M significantly increases. That is, when the magnetic field is increased, the permeability rapidly increases with the first magnetic field strength H1 as a boundary. The permeability in the second magnetic field region MF2 is close to the permeability of a soft magnetic material, so that the MnAl alloy according to the present embodiment behaves as a soft magnetic material in the second magnetic field region MF2.

When the magnetic field is further increased to exceed the second magnetic field strength H2 (to reach a third magnetic field region MF3), magnetic saturation occurs, so that the inclination of the graph, i.e., the permeability reduces again.

Conversely, when the magnetic field is reduced from the third magnetic field region MF3 to fall below a third magnetic field strength H3, the permeability increases again in the region up to a fourth magnetic field region H4. Then, the permeability reduces when the magnetic field falls below the fourth magnetic field strength H4, and the MnAl alloy according to the present embodiment behaves as a non-magnetic material again. As described above, the MnAl alloy according to the present embodiment has hysteresis in the first quadrant (I), but residual magnetization hardly exists, so that the same characteristics as those described above can be obtained when the magnetic field H is once set back to around zero.

Although the vertical axis indicates the magnetization M in the graphs illustrated in FIGS. 1 and 2, it may indicate a magnetic flux density B. Such substitution still can satisfy the relationship same with the former instance.

Figure 3:
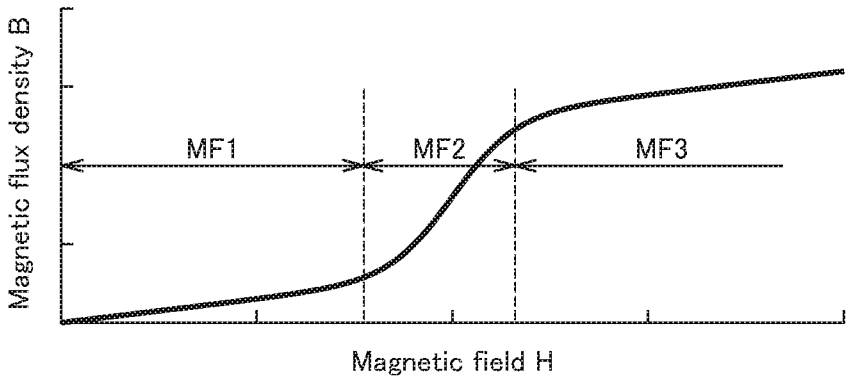
FIG. 3 is another graph illustrating the magnetic characteristics of the MnAl alloy exhibiting metamagnetism.

FIG. 3 is another graph illustrating the magnetic characteristics of the MnAl alloy according to the present embodiment. In this graph, the horizontal axis as a first axis indicates the magnetic field H, and the vertical axis as a second axis indicates the magnetic flux density B.

As illustrated in FIG. 3, even when the vertical axis indicates the magnetic flux density B, the magnetic characteristics of the MnAl alloy according to the present embodiment exhibits the same characteristic curve in the first quadrant (I) of the graph. That is, the inclination is small in the first magnetic field region MF1 with a low magnetic field, it rapidly becomes large in the second magnetic field region MF2 with a middle magnetic field, and it becomes small again in the third magnetic field region MF3 with a high magnetic field. Further, in the graph shown in FIG. 3, the characteristic curve representing the magnetic characteristics of the MnAl alloy according to the present embodiment passes substantially the origin of the graph and, even when the characteristic curve does not pass exactly the origin of the graph, it passes in the vicinity of the origin with respect to the horizontal or vertical axis.

Figure 4:
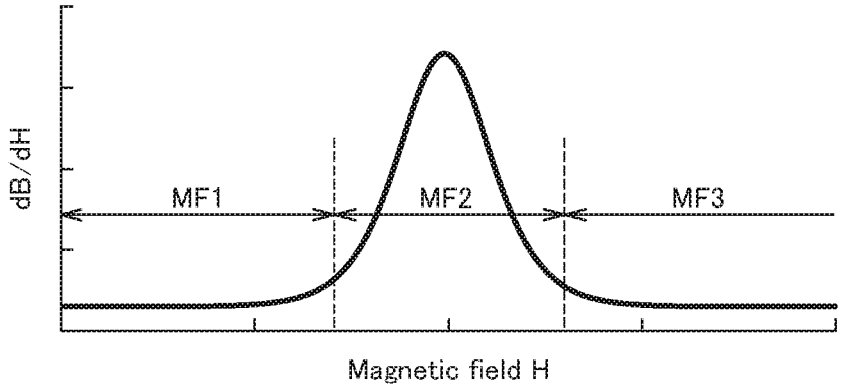
FIG. 4 is a graph illustrating the differential value of the characteristics illustrated in FIG. 3.
Figure 5:
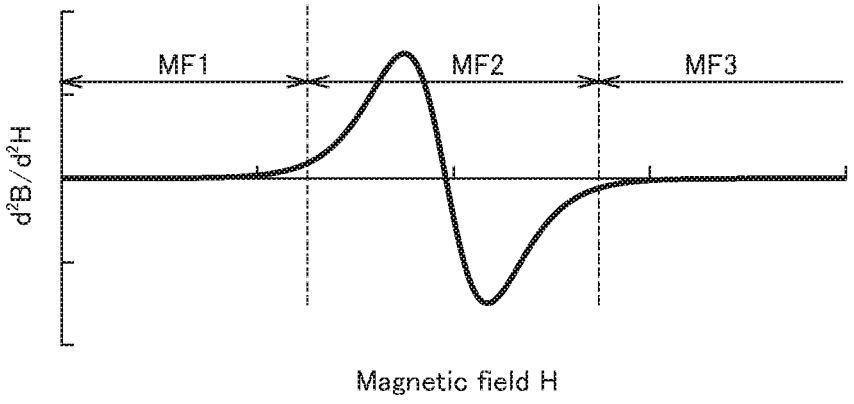

FIG. 4 is a graph illustrating the differential value of the characteristics illustrated in FIG. 3, and FIG. 5 is a graph illustrating the second order differential value of the characteristics illustrated in FIG. 3. The characteristics illustrated in FIG. 4 correspond to the differential permeability of the MnAl alloy according to the present embodiment.

As illustrated in FIG. 4, when the characteristics illustrated in FIG. 3 is subject to first order differentiation, the differential value becomes local maximum in the second magnetic field region MF2. In the first magnetic field region MF1 and third magnetic field region MF3, the differential value is still small. Then, as illustrated in FIG. 5, when the characteristics illustrated in FIG. 3 is subject to second order differentiation, the second order differential value is inverted from a positive value to a negative value in the second magnetic field region MF2. In the first magnetic field region MF1 and third magnetic field region MF3, the second order differential value is substantially zero. As described above, in the MnAl alloy according to the present embodiment, when the magnetic flux density B is subject to second order differentiation with respect to the magnetic field H, the second order differential value is inverted from a positive value to a negative value.

The MnAl alloy according to the present embodiment is obtained by electrolyzing molten salt in which a Mn compound and an Al compound are mixed and dissolved to deposit a MnAl alloy and then applying heat treatment to the MnAl alloy at a temperature of 400° C. or more and less than 600° C.

Figure 6:
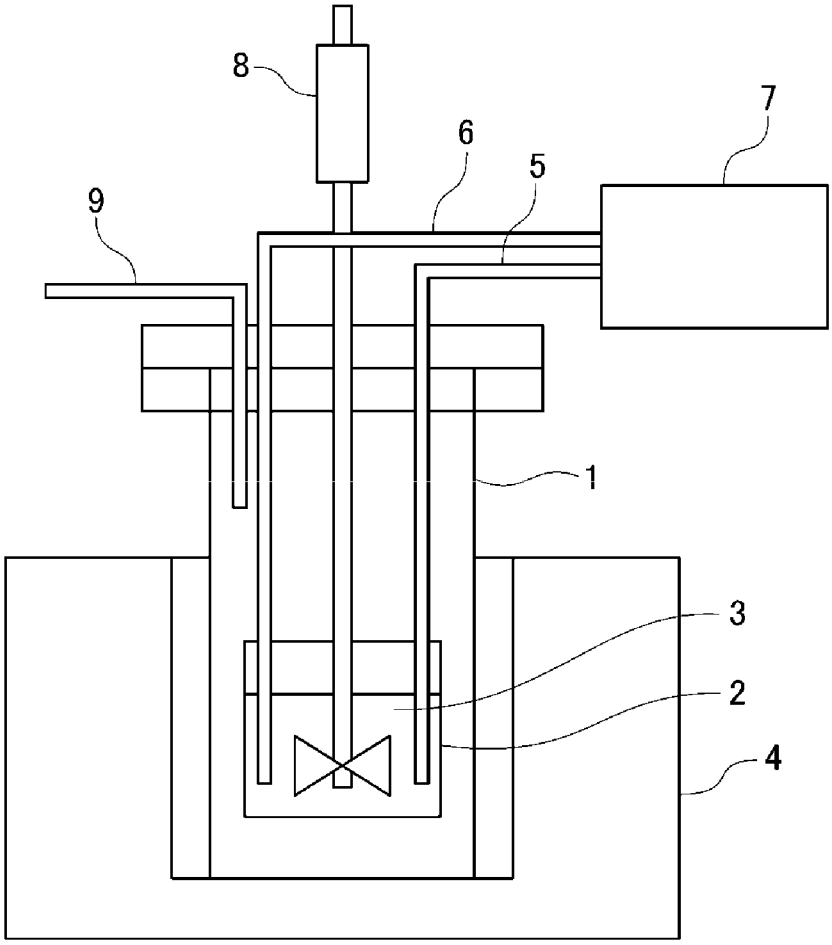
FIG. 6 is a schematic view of an electrodeposition apparatus for manufacturing the MnAl alloy.

FIG. 6 is a schematic view of an electrodeposition apparatus for manufacturing the MnAl alloy.

The electrodeposition apparatus illustrated in FIG. 6 has an alumina crucible 2 disposed inside a stainless sealed vessel 1. The alumina crucible 2 holds molten salt therein, and the molten salt 3 inside the alumina crucible 2 is heated by an electric furnace 4 disposed outside the sealed vessel 1. The alumina crucible 2 is provided inside thereof with a cathode 5 and an anode 6 immersed in the molten salt 3, and current is supplied to the cathode 5 and anode 6 through a constant current power supply device 7. The cathode 5 is a plate-like member made of Cu, and the anode 6 is a plate-like member made of Al. The molten salt 3 inside the alumina crucible 2 can be stirred by a stirrer 8. The sealed vessel 1 is filled with inert gas such as $N_2$ supplied through a gas passage 9.

The molten salt 3 contains at least a Mn compound and an Al compound. As the Mn compound, $MnCl_2$ can be used. As the Al compound, $AlCl_3$, $AlF_3$, $AlBr_3$, or $AlNa_3F_6$ can be used. The Al compound may be composed of $AlCl_3$ alone, and a part of $AlCl_3$ may be substituted with $AlF_3$, $AlBr_3$, or $AlNa_3F_6$.

The molten salt 3 may contain another halide in addition to the above-described Mn compound and Al compound. As another halide, an alkali metal halide such as NaCl, LiCl, or KCl is preferably selected, and a rare earth halide such as $LaCl_3$, $DyCl_3$, $MgCl_2$, $CaCl_2$), $GaCl_3$, $InCl_3$, $GeCl_4$, $SnCl_4$, $NiCl_2$, $CoCl_2$, or $FeCl_2$, an alkaline earth halide, a typical element halide, and a transition metal halide may be added to the alkali metal halide.

The above Mn compound, Al compound, and another halide are charged in the alumina crucible 2 and heated and melted by the electric furnace 4, whereby the molten salt 3 can be obtained. The molten salt 3 is preferably stirred sufficiently by the stirrer 8 immediately after melting so as to make the composition distribution of the molten salt 3 uniform.

The electrolysis of the molten salt 3 is performed by making current flow between the cathode 5 and the anode 6 through the constant current power supply device 7. This allows the MnAl alloy to be deposited on the cathode 5. The heating temperature of the molten salt 3 during the electrolysis is preferably 150° C. or more and 450° or less. The electricity amount is preferably 15 mAh or more and 150 mAh or less per electrode area of 1 $cm^2$. During the electrolysis, the sealed vessel 1 is preferably filled with inert gas such as $N_2$.

Further, the electricity amount of the current made to flow between the cathode 5 and the anode 6 is set to 50 mAh or more per 1 mass % concentration of the Mn compound in the molten salt 3 and per 1 $cm^2$ electrode area, whereby a powdery MnAl alloy can be deposited on the cathode 5. That is, the higher the concentration of the Mn compound in the molten salt 3, the more rapidly the deposition is accelerated, and the more the electricity amount per unit electrode area, the more rapidly the deposition is accelerated, and the MnAl alloy to be deposited easily becomes powdery when the above value range (50 mAh or more) is satisfied. When the MnAl alloy deposited on the cathode 5 is powdery, the deposition of the MnAl alloy is not stopped even when electrolysis is performed for a long time, thereby improving productivity of the MnAl alloy. Further, by compression molding the obtained powdery MnAl alloy, it is possible to obtain a desired product shape.

The initial concentration of the Mn compound in the molten salt 3 is preferably 0.2 mass % or more and, more preferably, 0.2 mass % or more and 3 mass % or less. Further, the Mn compound is preferably additionally thrown during electrolysis so as to maintain the concentration of the Mn compound in the molten salt 3. More specifically, powdery Mn compound or Mn compound in the form of pellets (obtained by molding powder) may additionally be thrown into the molten salt 3 continuously or periodically. When the Mn compound is additionally thrown during electrolysis of the molten salt 3, reduction in the concentration of the Mn compound associated with the progress of the electrolysis is suppressed, whereby the concentration of the Mn compound in the molten salt 3 can be maintained at a predetermined value or more. This makes it possible to suppress a variation in the composition of the MnAl alloy to be deposited.

The MnAl alloy deposited by electrolysis is then subjected to heat treatment, whereby metamagnetism can be imparted to the MnAl alloy. Specifically, by setting the temperature of the heat treatment to 400° C. or more and less than 600° C., metamagnetism can be imparted to the MnAl alloy. The heat treatment is preferably performed in an inert gas atmosphere or in a vacuum atmosphere.

The MnAl alloy according to the present embodiment can be applied to various electronic components. For example, when the MnAl alloy according to the present embodiment is used as a magnetic core, application to a reactor, an inductor, a current limiter, an electromagnetic actuator, a motor, or the like is possible. Further, when the MnAl alloy according to the present embodiment is used as a magnetic refrigeration substance, application to a magnetic refrigerator is possible.

It is apparent that the present invention is not limited to the above embodiments, but may be modified and changed without departing from the scope and spirit of the invention.

EXAMPLES

<Production of MnAl Alloy by Electrolysis Method>

First, an electrodeposition apparatus having the structure illustrated in FIG. 6 was prepared. As the cathode 5, a Cu plate having a thickness of 3 mm cut out so as to set the immersion area into the molten salt 3 to a size of 5 cm×8 cm was used. As the anode 6, an Al plate having a thickness of 3 mm cut out so as to set the immersion area into the molten salt 3 to a size of 5 cm×8 cm was used.

Then, 50 mol % anhydrous $AlCl_3$ which is an Al compound, 50 mol % NaCl which is another halide, and 1 mass % $MnCl_2$ dehydrated in advance as the Mn compound are weighed and thrown into the alumina crucible 2 such that the total weight thereof was 1200 g. Thus, the weight of $MnCl_2$ was g. The dehydration was performed by heating $MnCl_2$ hydrate at about 400° C. for four hours or longer in an inert gas atmosphere such as $N_2$.

The alumina crucible 2 into which the materials had been thrown was moved inside the sealed vessel 1, and the materials were heated to 350° C. by the electric furnace 4, whereby the molten salt 3 was obtained. Then, rotary vanes of the stirrer 8 were sunk into the molten salt 3, and stirring was performed at a rotation speed of 400 rpm for 0.5 hours. Thereafter, a constant current of 60 mA/$cm^2$ (2.4 A) per unit electrode area was conducted between the cathode 5 and the anode 6 for four hours, and the current conduction and heating were stopped. Then, the electrode was removed before the molten salt 3 would become cool and solid, and the cathode 5 is subjected to ultrasonic washing using acetone.

A film-like electrodeposit and powdery electrodeposits (MnAl alloy) were deposited on the surface of the cathode 5. The film-like electrodeposit was collected by dissolving and removing Cu constituting the cathode 5 and pulverized with a mortar into powder. Some of the powdery electrodeposits were left on the cathode 5, but the rest were deposited on the bottom portion of the alumina crucible 2. Therefore, the powdery electrodeposits sunk into the molten salt 3 were filtered and collected. At the same time, the molten salt was subjected to decantation, and the mixture of the powdery electrodeposits left on the bottom portion and the molten salt was cooled and solidified, followed by washing using acetone and filtering/collection. The powdery electrodeposits obtained by both the above collection methods were mixed with a powdery sample obtained by pulverizing the film-like electrodeposit.

The powder sample obtained by the above method was used as Comparative Example 1.

Further, samples of Comparative Examples 2 and 3 were produced in the same manner as Comparative Example 1 except that the electrodeposition temperatures therefor were set to 300° C. and 250° C., respectively.

<Heat Treatment for MnAl Alloy>

The powder sample of Comparative Example 1 was subjected to heat treatment at 350° C. to 700° C. in an Ar atmosphere for 16 hours. Samples subjected to heat treatment at 350° C., 400° C., 450° C., 500° C., 550° C., 575° C., 600° C., 650° C., and 700° C. were used as Comparative Example 4, Example 1, Example 2, Example 3, Example 4, Example 5, Comparative Example 5, Comparative Example 6, and Comparative Example 7, respectively.

Further, the powder samples of Comparative Examples 2 and 3 were subjected to heat treatment at 550° C. in an Ar atmosphere for 16 hours to produce samples of Examples 6 and 7.

<Production of MnAl Alloy by Melting Method>

Mn of purity 99.9 mass % or more and Al of purity 99.9 mass % or more were weighed in a ratio of 46 at %:54 at % and subjected to arc melting in an Ar atmosphere to produce a raw material ingot.

The obtained raw material ingot was subjected to heat treatment at 1150° C. in an Ar atmosphere for two hours, followed by in-water quenching. Thereafter, the resultant ingot was subjected to heat treatment at 600° C. in an Ar atmosphere for one hour, followed by slow cooling. Thereafter, the resultant ingot was pulverized in a stamp mill to obtain 100 μm or less powder. The obtained sample was used as Comparative Example 8.

Comparative Examples 9 to 14 were produced in the same manner as Comparative Example 8 except that the ratio between Mn and Al was changed.

<Evaluation of Magnetic Characteristics>

Magnetic characteristics were measured for samples of Examples 1 to 7 and Comparative Examples 1 to 14 in a magnetic field range of 0 kOe to 100 kOe at room temperature using a pulsed high field magnetometer (Toei Industry Co., Ltd.), and the presence/absence of metamagnetism was determined based on obtained magnetization curves. Further, mass magnetization at 100 kOe was set as maximum mass magnetization σmax, magnetization around 0 kOe was set as residual mass magnetization σr, and the ratio σr/σmax was set as a squareness ratio. A sample having a squareness ratio of 0.1 or more was determined to have residual magnetization, and a sample having a squareness ratio of less than 0.1 was determined not to have residual magnetization.

<Evaluation of Crystal Structure>

Diffraction intensity was measured for samples of Examples 1 to 7 and Comparative Examples 1 to 14 in a range of 20° to 80° at room temperature by Cuα1 radiation using an X-ray diffraction measuring apparatus (XRD, manufactured by Rigaku), followed by phase identification.

<Evaluation of Mn Concentration and Al Concentration>

Mn and Al contents were measured for samples of Examples 1 to 7 and Comparative Examples 1 to 14 using an ICP-AES (Inductively Coupled Plasma Atomic Emission Spectroscopy), and the atomic ratio between Mn and Al was evaluated.

<Evaluation of Mn and Al Concentrations of τ-MnAl Crystal Grains>

The samples of Examples 1 to 7 and Comparative Examples 1 to 14 were each embedded in resin, followed by polishing, and a part of the powder sample was thinned by FIB (Focused Ion Beam) machining. The atomic ratio between Mn and Al was evaluated for the obtained thin piece by STEM-EDS analysis (Scanning Transmission Electron Microscopy-Energy Dispersive Spectroscopy).

<Evaluation of Order Parameter>

Diffraction intensity was measured for samples of Examples 1 to 7 and Comparative Examples 1 to 14 in a range of 20° to 80° with a scanning interval of 0.020° and measurement time of 1.2 seconds at room temperature by Cuα1 radiation using an X-ray diffraction measuring apparatus (XRD, manufactured by Rigaku), and integrated intensity I (100) of (100) peak of the τ-MnAl phase observed around 32.2° and integrated intensity I (200) of (200) peak of the τ-MnAl phase observed around 67.4° were calculated. Then, a value obtained by calculating I (100)/I (200) was set as (I (100)/I (200)) Exp. On the other hand, a value of integrated intensity ratio I (100)/I (200) obtained when the τ-MnAl phase was perfectly ordered was set as (I (100)/I (200)) Theory, and the order parameter S was calculated according to the following calculating formula: $S=\sqrt{(I(100)/I(200))\ Exp./(I(100)/I(200))\ Theory}$.

The (I (100)/I (200)) Theory is a value obtained by diffraction intensity simulation software. In this case, 1.06 calculated by RIETAN-FP was used.

<Evaluation of Magnetic Structure>

The powder samples were measured in a range of 1 A to 40 A in terms of lattice spacing d by a time-of-flight neutron diffraction method, and when a magnetic structure having a longer period than the τ-MnAl crystal structure was observed, it was determined that crystal grains having an antiferromagnetic structure was present. In a case where not all the values of Miller indices (h, k, 1) of the diffraction peak attributable to the magnetic structure assume an integer when indexing is performed based on the crystal structure of the τ-MnAl, the presence of the long-period magnetic structure can be determined. The peak attributable to the magnetic structure is obtained by subtracting the peak attributable to the crystal structure obtained by the X-ray diffraction from the diffraction peak obtained by the neutron diffraction. For example, in Miller indices (1, 0, ½) indicating that a double-period magnetic structure is present in the c-axis direction of the τ-MnAl, the miller index 1 is ½, which is a rational number, so that it can be understood that a double-period magnetic structure is present in the c-axis direction.

<Evaluation Results>

Figure 8A:
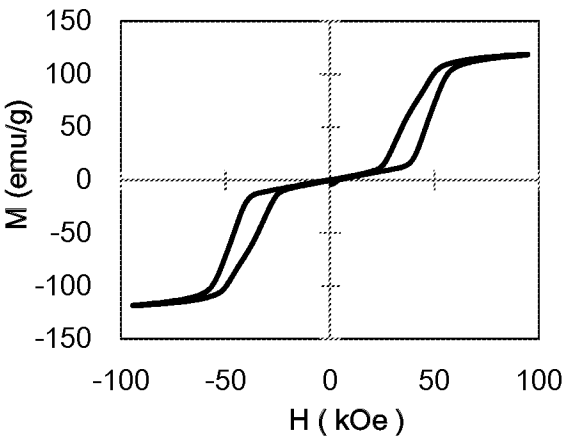
FIGS. 8A to 8D illustrate the magnetic characteristics of the samples of Example 3, Comparative Example 1, Comparative Example 5, and Comparative Example 13, respectively.
Figure 8B:
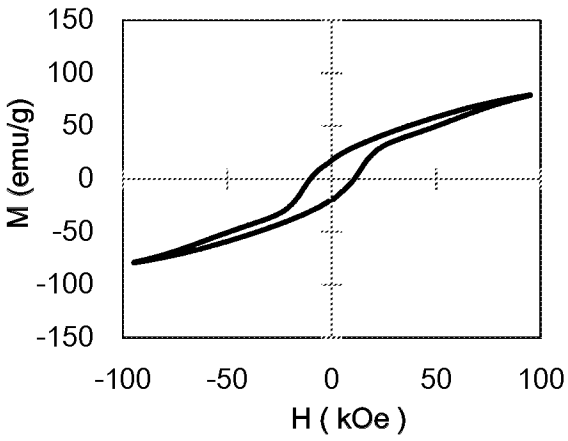
Figure 8C:
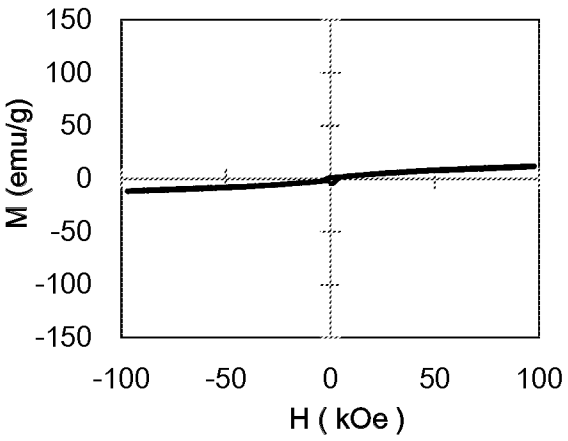
Figure 8D:
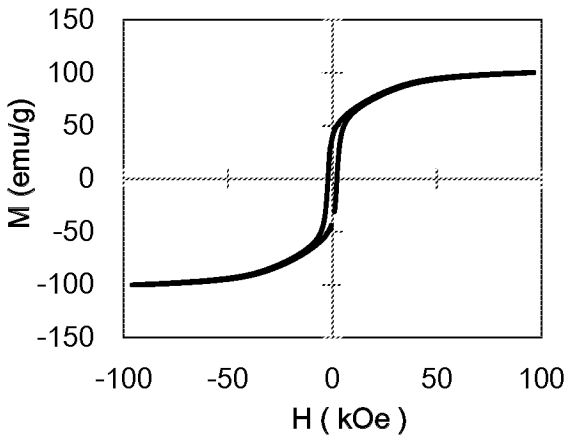
Figure 9A:
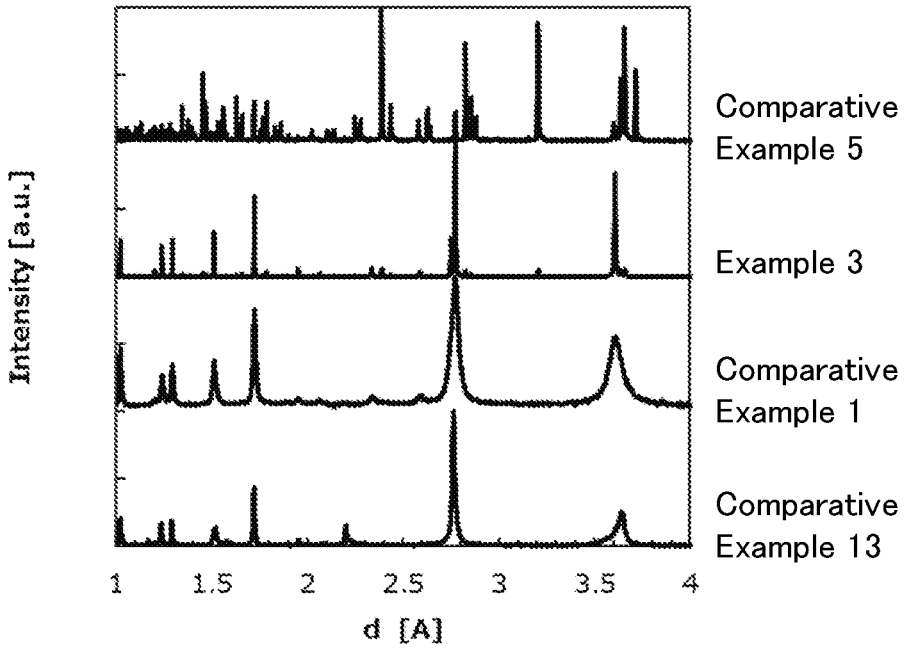
FIGS. 9A and 9B are graphs illustrating measurement results obtained by the neutron diffraction method of the samples of Example 3, Comparative Example 1, Comparative Example 5, and Comparative Example 13.
Figure 9B:
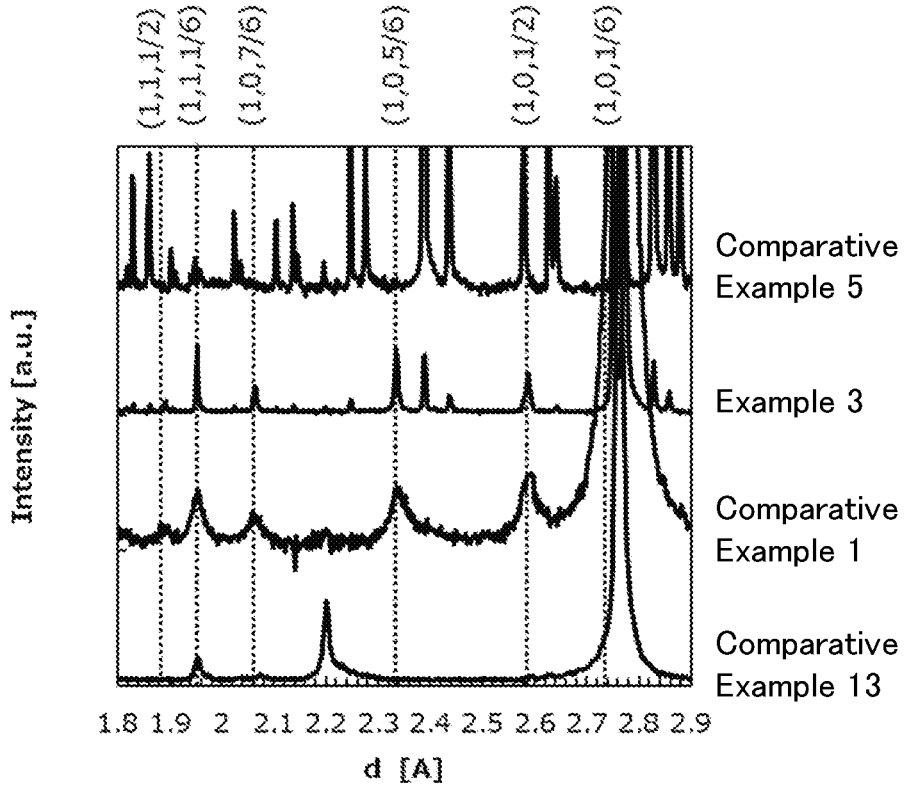

Evaluation results are shown in FIGS. 7, 8A to 8D, and 9A and 9B. FIGS. 8A to 8D are graphs illustrating the magnetic characteristics of the samples of Example 3, Comparative Examples 1, 5, and 13, respectively. FIGS. 9A and 9B are graphs illustrating measurement results in Example 3 and Comparative Examples 1, 5, and 13 which are obtained by the neutron diffraction method.

As shown in the table of FIG. 7, the samples of Examples 1 to 7 wherein the MnAl alloy obtained by the molten salt electrolysis method is subjected to heating treatment at 400° C. to 575° C. exhibit metamagnetism. FIG. 8A illustrates the magnetic characteristics of the sample of Example 3. Further, in the samples of Examples 1 to 7, the ratios of Mn in the τ-MnAl phase are 51%, 52%, 53%, 54.5%, 54.8%, 49%, and 48%, respectively. On the other hand, the ratios of Mn to the entire MnAl alloy are 50% in Example 1 to 5, 47.5% in Example 6, and 45% in Example 7.

On the other hand, all the samples of Comparative Examples 1 to 14 do not exhibit metamagnetism. Particularly, although the samples of Comparative Examples 1 to 5 and 11 to 14 have the τ-MnAl phase, they do not have metamagnetism unlike Examples 1 to 7. In the samples of Comparative Examples 1 to 5 and 11 to 14, the ratio of Mn in the τ-MnAl phase is 45% to 56%. The samples of Comparative Examples 6 to 10 each have a γ2 phase and do not have the τ-MnAl phase. As illustrated in FIGS. 8B to 8D, the sample of Comparative Example 1 exhibits ferromagnetism, sample of Comparative Example 5 exhibits non-magnetism, and samples of Comparative Example 13 exhibits soft magnetism.

Further, as illustrated in measurement results of FIGS. 9A and 9B obtained by the neutron diffraction method, Miller indices (1, 0, ⅙) or (1, 0, ½) containing a non-integer value are observed by the neutron diffraction in Example 3. This result is a rare example in which double period and sextuple period are observed in the c-axis direction of the τ-MnAl at the same time and, in this case, it can be determined that antiferromagnetic stricture exists although the detailed magnetic structure is unclear. In Comparative Example 13, Miller indices containing a non-integer value are not observed by the neutron diffraction. On the other hand, in Comparative Example 5, the τ-MnAl phase is not observed. In Comparative Example 1, Miller indices (1, 0, ½) are observed, but has a weaker diffraction intensity than Example 3. Further, Miller indices (1, 0, ⅙), which is observed in Example 3, are not observed.

Then, magnetic characteristics were evaluated in a temperature range of −100° C. to 200° C. for Example 3, Comparative Examples 1 and 13. The results are shown in Table 1.

TABLE 1

| | Measurement Temperature (° C.) | Metamagnetism |
|---|---|---|
| Comparative Example 1 | −100 | NO |
| | −50 | NO |
| | 25 | NO |
| | 50 | NO |
| | 100 | NO |
| | 150 | NO |
| | 200 | NO |
| Example 3 | −100 | YES |
| | −50 | YES |
| | 25 | YES |
| | 50 | YES |
| | 100 | YES |
| | 150 | YES |
| | 200 | YES |
| Comparative Example 11 | −100 | NO |
| | −50 | NO |
| | 25 | NO |
| | 50 | NO |
| | 100 | NO |
| | 150 | NO |
| | 200 | NO |

As shown in Table 1, the sample of Example 3 exhibits metamagnetism over a wide temperature range of −100° C. to 200° C.

REFERENCE SIGNS LIST

1: Sealed Vessel
2: Alumina crucible
3: Molten salt
4: Electric furnace
5: Cathode
6: Anode
7: Constant current power supply device
8: Stirrer
9: Gas passage

What is claimed is:

1. A MnAl alloy exhibiting metamagnetism,
wherein a composition of the MnAl alloy is expressed by $Mn_bAl_{100-b}$ and $45 \leq b \leq 50$,
wherein the MnAl alloy contains crystal grains having a τ-MnAl phase, and
wherein a composition of the τ-MnAl phase is expressed by $Mn_aAl_{100-a}$ and $48 \leq a \leq 55$.

2. The MnAl alloy as claimed in claim 1,
wherein a magnetic structure of the τ-MnAl phase has an antiferromagnetic structure in a non-magnetic field state.

3. The MnAl alloy as claimed in claim 2, wherein the composition of the τ-MnAl phase is expressed by $Mn_aAl_{100-a}$ and $50<a<55$.

4. The MnAl alloy as claimed in claim 1, wherein an order parameter of the τ-MnAl phase is 0.85 or more.

5. The MnAl alloy as claimed in claim 1, wherein the MnAl alloy exhibits the metamagnetism over a temperature range of −100° C. to 200° C.

6. The MnAl alloy as claimed in claim 1, wherein the MnAl alloy is in a powder form.

7. The MnAl alloy as claimed in claim 6, wherein the MnAl alloy has a predetermined shape by molding a powdery MnAl alloy.

8. An electronic component including the MnAl alloy as claimed in claim 1.

9. A method for manufacturing the MnAl alloy of claim 1, the method comprising:
depositing the MnAl alloy by electrolyzing molten salt containing a Mn compound and an Al compound; and
applying heat treatment to the MnAl alloy at a temperature of 400° C. or more and less than 600° C.

10. A MnAl alloy formed by subjecting Mn and Al to temperature-controlled electrolysis and heat treatment that result in the MnAl alloy exhibiting metamagnetism.

* * * * *